US009435175B2

(12) United States Patent
Chong et al.

(10) Patent No.: US 9,435,175 B2
(45) Date of Patent: Sep. 6, 2016

(54) OILFIELD SURFACE EQUIPMENT COOLING SYSTEM

(71) Applicant: Schlumberger Technology Corporation, Sugar Land, TX (US)

(72) Inventors: Jonathan Wun Shiung Chong, Sugar Land, TX (US); Lewis Callaway, Sugar Land, TX (US); Rajesh Luharuka, Katy, TX (US); William Troy Huey, Fulshear, TX (US); Hoang Phi-Dung Vo, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 284 days.

(21) Appl. No.: 14/075,247

(22) Filed: Nov. 8, 2013

(65) Prior Publication Data

US 2015/0129210 A1 May 14, 2015

(51) Int. Cl.

| | |
|---|---|
| ***E21B 36/00*** | (2006.01) |
| ***E21B 33/13*** | (2006.01) |
| ***E21B 43/267*** | (2006.01) |
| ***F28F 13/12*** | (2006.01) |
| ***F28F 27/02*** | (2006.01) |
| ***F28D 21/00*** | (2006.01) |

(52) U.S. Cl.

CPC ..... *E21B 36/006* (2013.01); *E21B 33/13* (2013.01); *E21B 43/267* (2013.01); *F28D 21/00* (2013.01); *F28F 13/12* (2013.01); *F28F 27/02* (2013.01)

(58) Field of Classification Search

CPC ..... E21B 36/00; E21B 36/001; E21B 36/006
See application file for complete search history.

(56) References Cited

U.S. PATENT DOCUMENTS

| | | | | |
|---|---|---|---|---|
| 4,007,786 | A | 2/1977 | Schlinger | |
| 6,415,866 | B1 * | 7/2002 | Baugh | E21B 36/00 166/304 |
| 2004/0218464 | A1 | 11/2004 | Arribau et al. | |
| 2006/0065400 | A1 | 3/2006 | Smith | |
| 2008/0078552 | A1 | 4/2008 | Donnelly et al. | |
| 2009/0008096 | A1 | 1/2009 | Schultz et al. | |
| 2010/0069270 | A1 | 3/2010 | Weinstein et al. | |
| 2010/0071899 | A1 | 3/2010 | Coquilleau et al. | |
| 2011/0005757 | A1 | 1/2011 | Hebert | |
| 2011/0079391 | A1 | 4/2011 | Bedouet et al. | |
| 2013/0153229 | A1 | 6/2013 | Abad et al. | |
| 2015/0273419 | A1 * | 10/2015 | Chong | B01F 15/06 166/308.1 |

OTHER PUBLICATIONS

International Search Report and Written Opinion issued in PCT/US2014/059476 on Feb. 26, 2015, 15 pages.

* cited by examiner

*Primary Examiner* — David Andrews
(74) *Attorney, Agent, or Firm* — Michael L. Flynn; Tim Curington

(57) ABSTRACT

Systems and methods for cooling process equipment are provided. The system includes a process fluid source, and a heat exchanger fluidly coupled with the process equipment and the process fluid source. The heat exchanger is configured to receive a process fluid from the process fluid source and transfer heat from the process equipment to the process fluid. The system also includes a control system fluidly coupled with the heat exchanger. The control system is configured to vary a temperature of the process fluid heated in the heat exchanger. Further, at least a portion of the process fluid heated in the heat exchanger is delivered into a wellbore at a temperature below a boiling point of the process fluid.

15 Claims, 6 Drawing Sheets

OILFIELD SURFACE EQUIPMENT COOLING SYSTEM

BACKGROUND

In some oilfield applications, pump assemblies are used to pump a fluid from the surface into the wellbore at high pressure. Such applications include hydraulic fracturing, cementing, and pumping through coiled tubing, among other applications. In the example of a hydraulic fracturing operation, a multi-pump assembly is often employed to direct an abrasive-containing fluid, i.e., fracturing fluid, through a wellbore and into targeted regions of the wellbore to create side fractures in the wellbore.

The fracturing fluid is typically formed at the wellsite in two steps, using two different assemblies. The first assembly, which generally contains a gel mixer, receives a process fluid and mixes the process fluid with a gelling agent (e.g., guar) and/or any other substances that may be desired. The gelled process fluid is then moved (pumped) to a blender, where it is blended with a proppant. The proppant serves to assist in the opening of the fractures, and also keeping the fractures open after deployment of the fluid is complete. The fluid is then pumped down into the wellbore, using the multi-pump assembly. Additionally, other types of dry additives and liquid additives at desired points in the fluids flow.

Each of these assemblies—gel mixing, proppant blending, and multi-pump—can include drivers, such as electric motors and/or other moving parts, which generate heat due to inefficiencies. To maintain acceptable operating conditions, this heat is offloaded to a heat sink. The simplest way to remove heat is with an air-cooled radiator, since the transfer medium and heat sink (air) are freely available. In contrast, liquid sources and heat sinks generally are not freely available, especially on land. However, air-cooled radiators require additional moving parts, which introduce a parasitic load on the assemblies, i.e., a load needed to keep the equipment cool but not otherwise contributing to the operation.

Further, air-cooled radiators are large, heavy, and noisy. Each of these considerations may impact the surrounding environment, increase footprint, and may impede portability, usually requiring permits for overweight and/or oversized equipment, and more restrictions on possible journey routes. For offshore applications, weight and size both come at a premium, and being lighter and smaller may offer a competitive advantage. Further, in offshore installations, large radiators may need to be remotely installed from the primary equipment (e.g., a few decks above where the primary equipment is installed) due to their size, which can require additional coolant and hydraulic or electric lines. Additionally, air-cooled radiators may be subject to extreme ambient temperatures and/or altitudes, which may limit their efficacy.

SUMMARY

Embodiments of the disclosure provide a system and method for cooling process equipment. In one example, the system includes a heat exchanger, which receives a flow of process fluid from a source. The heat exchanger transfers heat from heat-generating process equipment to the process fluid. The process fluid is then mixed with additives or otherwise prepared for delivery downhole, according to the wellbore operation in which it is being used. As such, the wellbore acts as a heat sink, while the process fluid serves as the heat transfer medium. Moreover, this system recovers what may otherwise be wasted heat from the heat-generating components and uses it beneficially to aid in mixing processes and/or to maintain the process fluid above freezing temperatures in cold ambient conditions. The system may also include a temperature control system that maintains the temperature of the heated process fluid within a range of temperatures. For example, the range of temperatures may be selected to enhance the efficiency of the additive mixing process.

While the foregoing summary introduces one or more aspects of the disclosure, these and other aspects will be understood in greater detail with reference to the following drawings and detailed description. Accordingly, this summary is not intended to be limiting on the disclosure.

BRIEF DESCRIPTION OF THE DRAWINGS

The accompanying drawings, which are incorporated in and constitute a part of this specification, illustrate an embodiment of the present teachings and together with the description, serve to explain the principles of the present teachings. In the figures.

Figure 1:
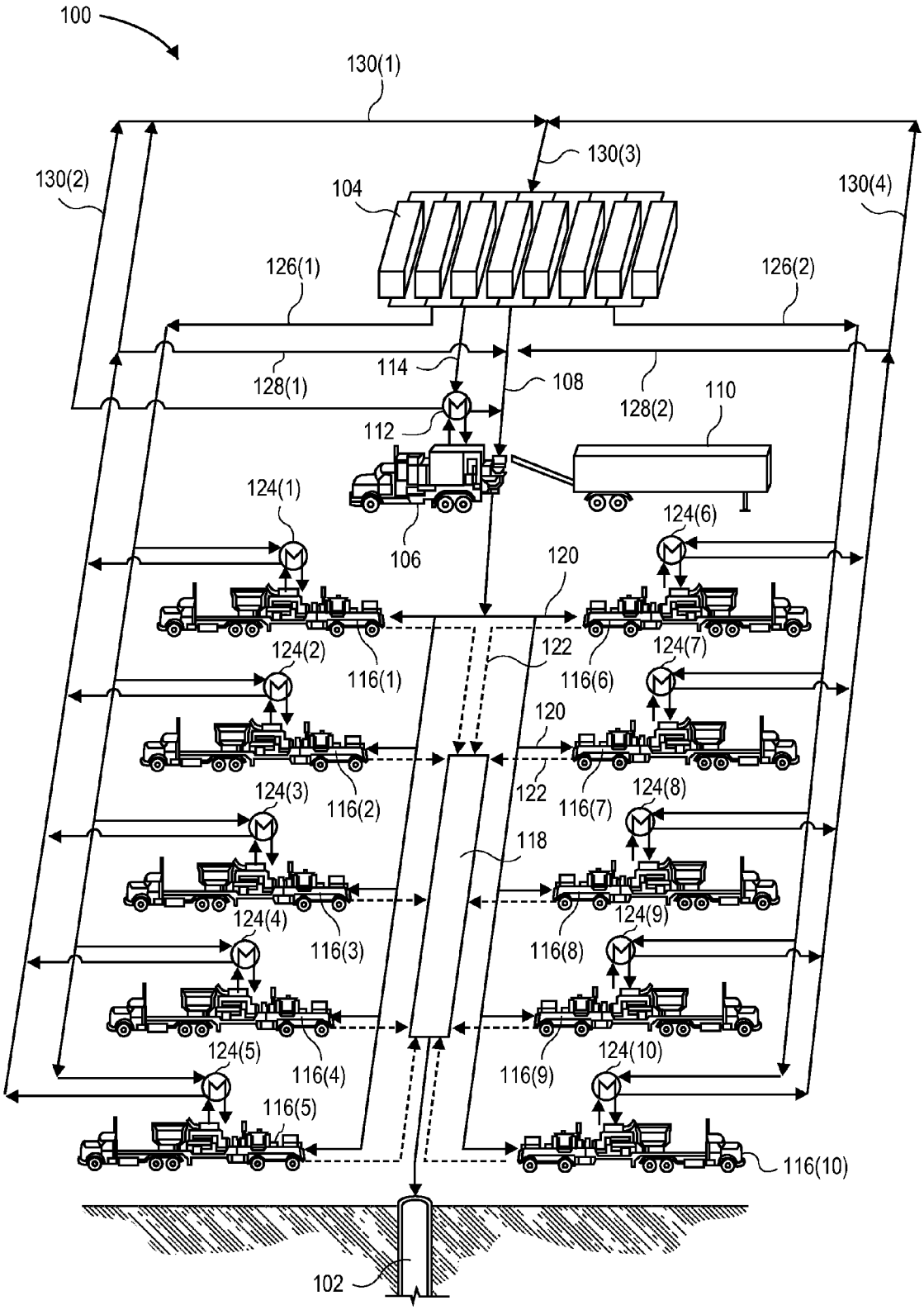
FIG. 1 illustrates a schematic view of a system for preparing and delivering fluids into a wellbore, according to an embodiment.

It should be noted that some details of the figures have been simplified and are drawn to facilitate understanding of the embodiments rather than to maintain strict structural accuracy, detail, and scale.

DETAILED DESCRIPTION

Reference will now be made in detail to embodiments of the present disclosure, examples of which are illustrated in the accompanying drawings. In the drawings and the following description, like reference numerals are used to designate like elements, where convenient. It will be appreciated that the following description is not intended to exhaustively show all examples, but is merely exemplary.

FIG. 1 illustrates a schematic view of a system 100 for preparing and delivering fluids into a wellbore 102, according to an embodiment. In the illustrated embodiment, the system 100 may be configured for performing a hydraulic fracturing operation in the wellbore 102; however, it will be appreciated that the system 100 may be configured for a variety of other applications as well. Further, the system 100 may be located proximal to a wellsite, but in other embodiments, all or a portion thereof may be remote from the wellsite. In an embodiment, the system 100 may include a fluid source 104, which may include one or more tanks, as shown, containing water, other elements, fluids, and/or the like. The contents of the fluid source 104 may be referred to as "process fluid," and may be combined with other materials to create a desired viscosity, pH, composition, etc., for delivery into the wellbore 102 during performance of a wellbore operation, such as hydraulic fracturing. In at least one embodiment, the process fluid may be delivered into the wellbore 102 at a temperature that is below the boiling point of the process fluid.

The system 100 may also include a fluid preparation assembly 106, which may receive the process fluid from the fluid source 104 via an inlet line 108 and combine the process fluid with one or more additives, such as gelling agents, so as to form a gelled process fluid. The fluid preparation assembly 106 may also receive additives from a proppant feeder 110, which may be blended with the gelled process fluid, such that the process fluid forms a fracturing fluid. Accordingly, the fluid preparation assembly 106 may perform functions of a gel-maker and a proppant blender. Further, the fluid preparation assembly 106 may be disposed on a trailer or platform of a single truck, e.g., in surface-based operations; however, in other embodiments, multiple trucks or skids or other delivery and/or support systems may be employed.

To support this functionality, the fluid preparation assembly 106 may include one or more blenders, mixers, pumps, and/or other equipment that may be driven, e.g., by an electric motor, diesel engine, turbine, etc. Accordingly, the fluid preparation assembly 106 may generate heat, which may be offloaded to avoid excessive temperatures. As such, the fluid preparation assembly 106 may thus include a heat exchanger 112 to cool the blenders, mixers, pumps and/or their associated drivers.

The heat exchanger 112 may be a liquid-liquid or gas-liquid heat exchanger of any type, such as, for example, a plate, pin, spiral, scroll, shell-and-tube, or other type of heat exchanger. Further, although one is shown, it will be appreciated that the heat exchanger 112 may be representative of several heat exchangers, whether in series or parallel. In an example, the heat exchanger 112 may be fluidly coupled with process equipment of the fluid preparation assembly 106, e.g., the driver of the process equipment. In some embodiments, the heat exchanger 112 may receive hot lubrication fluid from one or more pieces of equipment of the fluid preparation assembly 106 and/or may receive a hot cooling fluid that courses through a cooling circuit of the same or other components of the fluid preparation assembly 106. Accordingly, the hot fluids may carry heat from the process equipment to the heat exchanger 112.

To cool the hot lubrication/cooling fluid, the system 100 may divert at least some of the process fluid from the fluid source 104 to the heat exchanger 112 via inlet line 114. In the heat exchanger 112, heat may be transferred from the hot fluids to the process fluid, thereby cooling the hot lubrication/cooling fluids, which may be returned to the process equipment as cooled fluids. Further, the diverted process fluid, now warmed by receiving heat from the hot fluids in the heat exchanger 112, may be returned, e.g., to the inlet line 108, or anywhere else suitable in the system 100, as will be described in greater detail below.

The system 100 may further include one or more high-pressure pumps (e.g., ten as shown: 116(1)-(10)), which may be fluidly coupled together via one or more common manifolds 118. Process fluid may be pumped at low pressure, for example, about 60 psi (414 kPa) to about 120 psi (828 kPa) to pumps 116(1)-(10). The pumps 116(1)-116(10) may pump the process fluid at a higher pressure into the manifold 118 via the dashed, high pressure lines 122. The high pressure may be determined according to application, but may be, for example, on the order of from about 5,000 psi (41.4 MPa) to about 15,000 psi (124.2 MPa), at flowrates of, for example, between about 10 barrels per minute (BPM) and about 100 BPM, although both of these parameters may vary widely. The pressure, flowrate, etc., may correspond to different numbers and/or sizes of the high-pressure pumps 116(1)-(10); accordingly, although ten pumps 116(1)-(10) are shown, it will be appreciated that any number of high-pressure pumps, in any configuration or arrangement, may be employed, without limitation.

In an embodiment, the manifold 118 may be or include a missile trailer or missile. Further, in a specific embodiment, the high-pressure pumps 116(1)-(10) may be plunger pumps; however, in various applications, other types of pumps may be employed. Further, the high-pressure pumps 116(1)-(10) may not all be the same type or size of pumps, although they may be, without limitation.

As with the fluid preparation assembly 106, operation of the high-pressure pumps 116(1)-(10) may generate heat that may need to be dissipated or otherwise removed from the pumps 116(1)-(10), e.g., in the drivers of the pumps 116(1)-(10). Accordingly, the high-pressure pumps 116(1)-(10) may each include or be fluidly coupled to one or more heat exchangers 124(1)-(10). The heat exchangers 124(1)-(10) may be liquid-liquid or gas-liquid heat exchangers such as, for example, plate, pin, spiral, scroll, shell-and-tube, or other types of heat exchangers. Further, although one heat exchanger 124(1)-(10) is indicated for each of the high-pressure pumps 116(1)-(10), it will be appreciated that each heat exchanger 124(1)-(10) may be representative of two or more heat exchangers operating in parallel or in series, or two or more of the pumps 116(1)-(10) may be fluidly coupled to a shared heat exchanger 124.

The heat exchangers 124(1)-(10) may each receive a hot fluid from one or more other components of the high-pressure pump 116(1)-(10) to which they are coupled, with the hot fluid carrying heat away from the high-pressure pumps 116(1)-(10). For example, the heat exchangers 124 (1)-(10) may receive a hot lubrication fluid from a lubrication system of one or more components. Additionally or instead, the heat exchangers 124(1)-(10) may receive a hot cooling fluid, which may course through a cooling fluid circuit of one or more of the components of the high-pressure pumps 124(1)-(10).

To cool the hot fluids in the heat exchangers 124(1)-1(10), the system 100 may receive process fluid from the fluid source 104 via inlet lines 126(1) and 126(2). Although two rows and two inlet lines 126(1)-(2) are shown, it will be appreciated that any configuration of inlet lines 126 and any arrangement of high-pressure pumps 116(1)-(10) may be employed. The process fluid via inlet lines 126(1)-(2) may be fed to the heat exchangers 124(1)-(10), e.g., in parallel. Once having transferred heat from the hot fluids in the heat exchangers 124(1)-(10), the warmed process fluid may be returned to the inlet line 108 (or any other location in the system 100), via return lines 128(1) and 128(2), as will be described in greater detail below.

The process fluid in inlet line 108 may thus include process fluid that was received in the heat exchanger 112 and/or one or more of the heat exchangers 124(1)-(10) so as to cool the process equipment, in addition to process fluid that was not used for cooling the process equipment, which may be recirculated to the fluid source 104 via lines 130 (1)-(4). Further, this process fluid in the inlet line 108 may be received into the fluid preparation assembly 106, where it may be mixed/blended with gelling agents, proppant, etc., pumped into the high-pressure pumps 116(1)-(10), into the manifold 118, and then delivered into the wellbore 102. As such, the process fluid, delivered into the wellbore 102 to perform the wellbore operation (e.g., fracturing), is also used to cool the assembly 106 and high-pressure pumps 116(1)-(10), in an embodiment. Thus, the process fluid itself, deployed into the wellbore 102 to perform one or more wellbore operations (e.g., fracturing) acts as the primary heat sink for the process equipment. Secondary losses to the atmosphere from e.g., surfaces of pipes may also occur prior to arriving at the primary heat sink i.e., wellbore 102.

It will be appreciated that the process fluid may be diverted to the heat exchangers 112, 124(1)-(10) from any suitable location in the system 100. For example, the process fluid may be diverted at one or more points downstream from the fluid preparation assembly 106, and/or downstream from one or more mixing components thereof, rather than or in addition to upstream of the fluid preparation assembly 106, as shown. In such embodiments, the process fluid, which may be mixed with gelling agents, proppant and/or other additives, may course through the heat exchangers 112 and/or 124(1)-(10), which may avoid sending heated process fluid to the fluid preparation assembly 106 and/or the high-pressure pumps 116(1)-(10). Further, various processes, designs, and/or devices may be employed reduce the likelihood of fouling in the heat exchangers 112, 124(1)-(10), such as regular reversed flow, using hydrochloric acid (HCL) to remove scales, etc.

Figure 2:
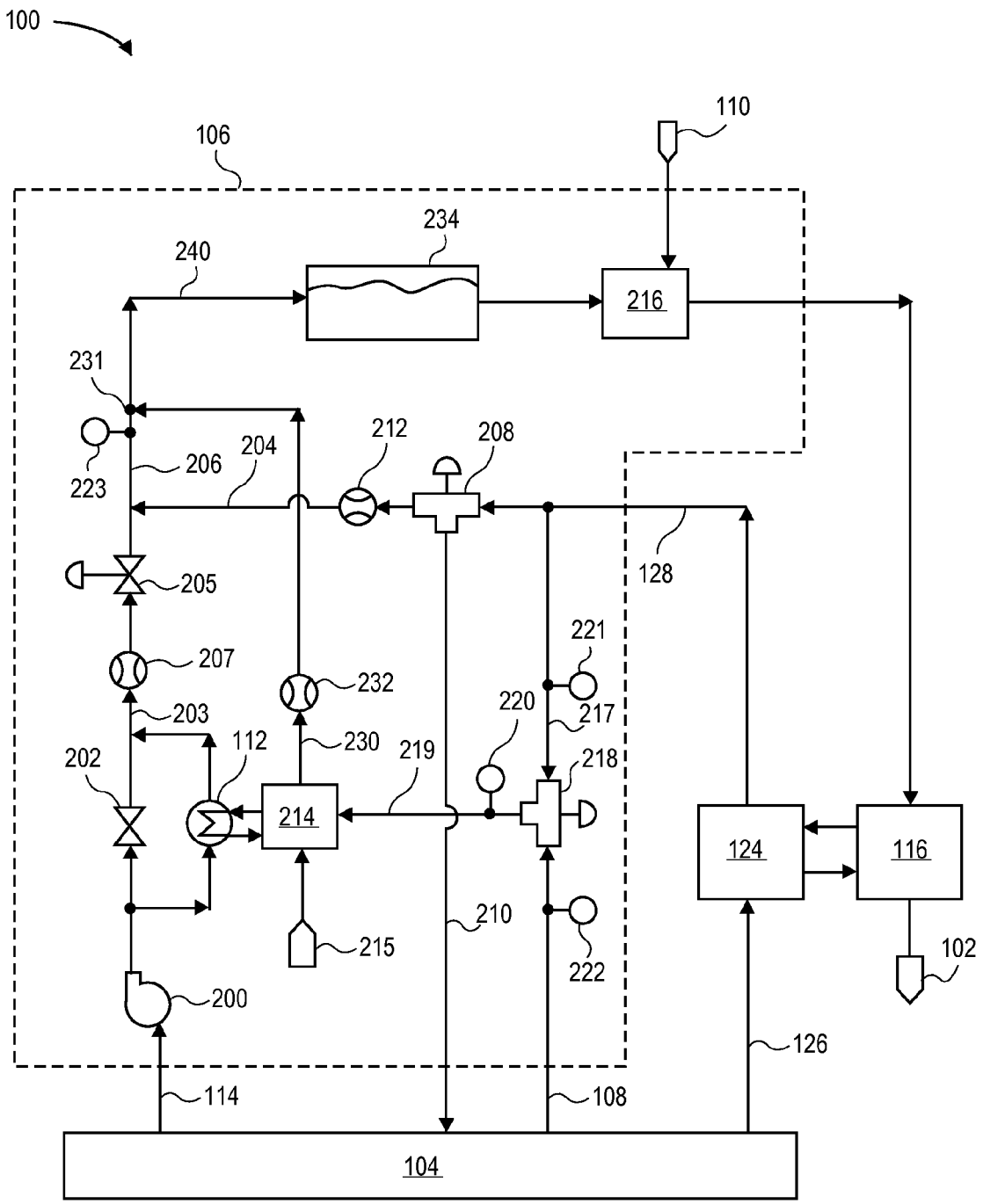
FIG. 2 illustrates a schematic view of the system, showing a more detailed view of the fluid preparation assembly, according to an embodiment.

FIG. 2 illustrates a schematic view of the system 100, showing a more detailed view of the fluid preparation assembly 106, according to an embodiment. As described above, the system 100 includes the fluid source 104 of process fluid, the proppant feeder 110, the one or more high-pressure pumps 116, and the one or more heat exchangers 124 fluidly coupled to or forming part of the high-pressure pumps 116. Further, as also described above, the assembly 106 includes or is coupled to the heat exchanger 112.

Turning now to the assembly 106 in greater detail, according to an embodiment, the assembly 106 may include a top-up (or "dilution") pump 200, which may be coupled with the fluid source 104, so as to receive process fluid therefrom via the inlet line 114. The top-up pump 200 may pump the process fluid to the heat exchanger 112. Further, the top-up pump 200 may include one or more heat-generating devices, such as electric motors, gas engines, turbines, etc.

The flowrate of the process fluid in the various lines of the system 100, as will be further described below, and the combination thereof with other streams of, e.g., process fluid from the source 104, may be controlled by a temperature control system. The temperature control system may include various temperature sensors, flow meters, and/or valves (e.g., bypass valves, control valves, flowback valves, other valves, etc.), as will also be described in further detail below. The sensors and flowmeters may serve as input devices for the control system, gathering data about the operating state of the system 100. In turn, the operating state of the system 100, including temperature of the process fluid in the various lines, may be changed by changing the position of the valves of the control system. Further, flowrate changes, and thus potentially temperature changes, may also be provided by varying a speed of one or more pumps of the system 100, e.g., the top-up pump 200, in any manner known in the art.

The decision-making functionality of the control system may be provided by a user, e.g., reading gauges of the measurements taken by the input devices and then modulating the valves. In other embodiments, the control system may be operated automatically, with a computer modulating the valves in response to the input, according to, for example, pre-programmed rules, algorithms, etc.

Returning to the assembly 106 shown in FIG. 2, the flowrate of the process fluid pumped to the heat exchanger 112 may be controlled via a bypass valve 202, which may be disposed in parallel with the heat exchanger 112. The bypass valve 202 may allow fluid to bypass the heat exchanger 112, e.g., to allow a greater throughput than may be pumped through the heat exchanger 112. In a specific embodiment, the flowrate via inlet line 114 may be the minimum flow rate required for cooling as determined by heat exchanger 112.

Once pumped through the bypass valve 202 and the heat exchanger 112, the process fluid may be received in a line 203. The flowrate of the process fluid in the line 203 may be controlled using a valve 205, which may be modulated in response to measurements taken by a flow meter 207, controlled by modulation of the pump 200 speed, or both. The process fluid in line 203 may then be joined by a heated process fluid from a line 204, extending from a flowback control valve 208, with the combination flowing through a line 206. The flowrate of the heated process fluid in the line 204 may be measured using a flow meter 212. The flow to and from the flowback control valve 208 will be described in greater detail below. Once joined together, the total desired dilution flowrate in line 206 may be a summation of flowrates from line 203 and line 204. Moreover, the ratio of flowrates from line 203 and line 204 may be controlled by modulation of flowback control valve 208, as will also be described in greater detail below.

The fluid preparation assembly 106 may also include one or more mixing assemblies (two shown: 214, 216). The mixing assembly 214 may be provided for gel dispersion and mixing, and may be referred to herein as the "gel mixing assembly" 214. The gel mixing assembly 214 may include one or more heat generating devices, such as electric motors, gas engines, turbines, etc., configured to drive pumps, mixers, etc. Further, the gel mixing assembly 214 may receive a gelling agent from a source (e.g., hopper) 215, mix the process fluid with the gelling agent, and pump the gelled process fluid therefrom.

The other mixing assembly 216 may be a blender for mixing proppant into gelled process fluid, and may be referred to herein as the "proppant mixing assembly" 216. The proppant mixing assembly 216 may receive the proppant from the proppant feeder 110, for mixing with the process fluid downstream from the gel mixing assembly 214. Accordingly, the proppant mixing assembly 216 may also include one or more heat-generating devices, such as electric motors, diesel engines, turbines, pumps, mixers, rotating blades, etc., e.g., so as to blend the proppant into the process fluid, move the process fluid through the system 100, etc.

The pump 200 and either or both of the mixing assemblies 214, 216 may be fluidly coupled with the heat exchanger 112. For purposes of illustration, the gel mixing assembly 214 is shown fluidly coupled thereto, but it is expressly contemplated herein that the proppant mixing assembly 216 and/or the pump 200 may be coupled with the heat exchanger 112, or to another, similarly configured heat exchanger 112. In the illustrated embodiment, the gel mixing assembly 214 may provide a hot cooling/lubrication fluid from one or more components thereof to the heat exchanger 112, which may transfer heat therefrom to the process fluid received from the pump 200. The hot cooling/lubrication fluid may thus be cooled, generating a cooled fluid that is returned to the gel mixing assembly 214 as part of a closed or semi-closed cooling fluid circuit.

Further, the gel mixing assembly 214 may receive process fluid from a three-way control valve 218 via line 219, which may be manually or computer controlled. The control valve 218 may receive process fluid from two locations: the process fluid source 104 via the inlet line 108 and the heat exchangers 124 via a line 217 coupled with the return line(s) 128 that are coupled with the heat exchangers 124. As noted with respect to FIG. 1, the heat exchanger(s) 124 may receive the process fluid via the inlet line(s) 126. In one example, the control valve 218 may control the flow of process fluid from inlet line 108 and line 217, e.g., based on temperature, such that the ratio of the flowrates in inlet line 108 and line 217 results in the process fluid in line 219 being at a temperature that is within a range of suitable temperatures for gel mixing in the gel mixing assembly 214. In at least one embodiment, the maximum temperature in the range of suitable temperatures may be less than the boiling point of the process fluid.

For example, the fluid preparation assembly 106 may also include temperature sensors 220, 221, 222, 223. The temperature sensors 220-223 may be configured to measure a temperature in lines 219, 217, 108, and 206 respectively. The temperature of the process fluid in line 217 may be raised by transfer of heat from the heat exchangers 124. In some cases, this heightened temperature process fluid may be beneficial, since warmed process fluid may aid in accelerating the gelling hydration process within the gel mixing assembly 214.

In cold ambient conditions, the system 100 may be used to heat process fluids "on-the-fly" to a minimum temperature that promotes mixing gel, hence reducing or avoiding heating the process fluids by additional equipment such as hot oilers. In addition, the recovered heat from the heat-generating devices (e.g., the pump 200, the mixing assemblies 214, 216, and/or the pumps 116), which may otherwise be wasted to the environment, can be used to avoid process fluids from freezing in the lines, and/or may, in some cases, be recovered for other purposes (e.g., electrical power generation, heating, powering thermodynamic cooling cycles, etc.) as well.

However, in some instances, the temperature in the process fluid received from the heat exchangers 124 may be higher than desired, which can impede certain mixing processes within the system 100, e.g., within the mixing assemblies 214, 216. Accordingly, a controller (human or computer) operating the temperature control system may determine that a temperature in the line 219, as measured by the sensor 220, is above a predetermined target temperature or temperature range, and may modulate the control valve 218 to increase or decrease the flowrate of process fluid directly from the fluid source 104 and from the heat exchangers 124. In some cases, the sensors 221 and/or 222 may be omitted, with the feedback from the sensor 220 being sufficient to inform the controller (human or computer) whether to increase or decrease flow in either the line 217 or the inlet line 108. Further, the sensors 221 and/or 222 may be disposed in the heat exchanger 124 or fluid source 104, respectively.

The control valve 218 may be proportional. Thus, increasing the flowrate of the process fluid in the inlet line 108 may result in a reduced flowrate of process fluid through line 217. When the flowrate of the fluid through line 217 is reduced, a portion of the process fluid received from the heat exchangers 124 via the return line 128 may be fed to the flowback control valve 208, and then back to the fluid source 104 via flowback line 210, and/or to the line 204, which combines with the line 203 downstream from the heat exchanger 112. In an embodiment, the flowrate of line 204 may be the primary flowrate that determines the flowrate of line 203, in order to obtain a desired total flow rate in line 206. This is also considering that the minimum flow rate in line 203 is equal the minimum flow rate for cooling in inlet line 114, as explained above.

In many cases, minimal to no flow may be recirculated back to fluid source 104 via flowback line 210. Hence, the flowrate in line 128 (from the heat exchangers 124) may equal a target flowrate in line 206 less the flowrate in line 203. Accordingly, the flowback control valve 208 may proportionally reduce or increase flow in the line 204 to reach the target flowrate and reduce or increase flow in the flowback line 210, as needed.

There may be several conditions in which flowback through flowback line 210 is employed. For example, if the temperature in line 206 is above a threshold that negatively affects the mixing process, due to heightened temperature of fluid from line 128, a portion of the heated process fluid in line 128 may be routed back to the fluid source 104. In such case, the ratio of flow in line 204 and the flow in line 210 may be determined according to the minimum allowable flow in line 204 in order to keep the temperature in line 206 below the threshold, with any fluid in excess of this amount being recirculated back to the fluid source 104 via the flowback line 210.

Another example in which flowback via flowback line 210 may be employed may occur when conditions in heat exchanger 124 dictate that there will be some excess flow from line 128, i.e., when the desired total dilution flowrate in line 206 less the flowrate at line 203, is less than the flowrate in line 128. This excess flow may be recirculated back to fluid source 104 through flowback line 210. In an embodiment, a combination of design and controls may minimize or avoid recirculating heated process fluid back to the fluid source 104, e.g., to avoid affecting the temperature of the process fluid in the process fluid source 104. Further, it will be appreciated that modulating each of the valves 208, 218 may affect the position of the other. Accordingly, the valve positioning may be optimized using forward modeling, valve sequencing, or through trial and error.

The process fluid received via line 219 into the gel mixing assembly 214, once mixed with the gelling agents, may be pumped out of the gel mixing assembly 214 via a line 230 and combined with process fluid in the line 206, for example, at a point 231 downstream of the heat exchanger 112, e.g., downstream of the temperature sensor 223. A flow meter 232 may measure a flowrate of the gelled process fluid pumped from the gel mixing assembly 214. Accordingly, a combination of the flowrate in the line 206, which is the summation of the flowrate measured by the flow meter 207 and flow meter 212, and the flowrate of the gelled process fluid in the line 230, measured by flow meter 232, may provide a combined process fluid flowrate, i.e., downstream of the point 231.

The process fluid in line 206 may be water, which will dilute a concentrated gelled process fluid from line 230 at point 231, yielding a diluted, gelled process fluid in line 240. The diluted, gelled process fluid may be received into a tank 234 via line 240. The tank 234 may serve primarily as a header tank to provide enough suction head to the proppant mixing assembly 216, in at least one embodiment. From the tank 234, the diluted, gelled process fluid may be fed to the proppant mixing assembly 216, which may combine the diluted, gelled process fluid with proppant, thereby forming the fracturing fluid. The fracturing fluid may then be delivered to the high-pressure pumps 116 and then to the wellbore 102 (e.g., via the manifold 118, see FIG. 1).

Figure 3:
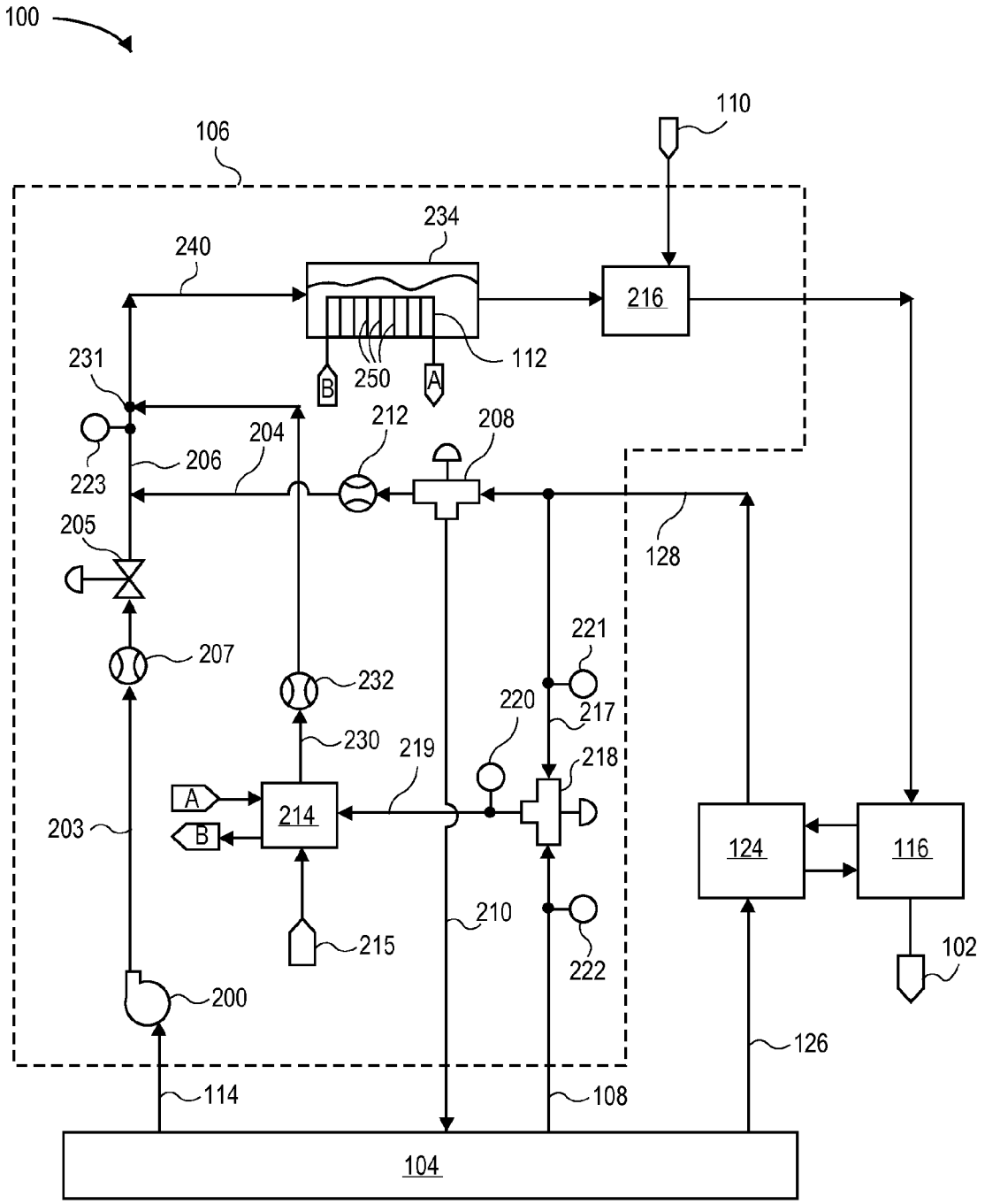
FIG. 3 illustrates a schematic view of the system, showing another embodiment of the fluid preparation assembly.

FIG. 3 illustrates a schematic view of the system 100, showing another embodiment of the fluid preparation assembly 106. The embodiment of the fluid preparation assembly 106 of FIG. 3 may be generally similar to that of FIG. 2; however, the placement and configuration of the heat exchanger 112 may be different. As shown in FIG. 3, the heat exchanger 112 may be disposed in the tank 234, and fluidly coupled with the gel mixing assembly 214 at points A and B. In other embodiments, the heat exchanger 112 may be fluidly coupled with the proppant mixing assembly 216 and/or pump 200 instead of or in addition to being fluidly coupled with the gel mixing assembly 214. Placing the heat exchanger 112 in the tank 234 may reduce a footprint of the assembly 106 by combining the area taken up by the tank 234 and the heat exchanger 112.

In this embodiment, the heat exchanger 112 may include plates or tubing 250 immersed in the diluted, gelled process fluid contained in the tank 234. The plates or tubing 250 may be configured to rapidly transfer heat therefrom to the surrounding process fluid, which may be agitated, moved, or quiescent. Further, as the process fluid is removed from the tank 234 for delivery into the proppant mixing assembly 216 and ultimately downhole, heat transferred to the process fluid from the heat exchanger 112 may be removed. Moreover, the plates or tubing 250 may have a gap on the order of about 1 inch (2.54 cm) or more, so as to allow the higher viscosity, diluted, gelled process fluid to pass by, while reducing a potential for clogging, fouling from debris (rocks, sand, etc.), and/or the like. Other strategies for addressing fouling, such as caused by a deposit of matter on the heat transfer surfaces of the heat exchanger 112 exposed to the diluted, gelled process fluid, may include the use of super-hydrophobic/super-oleophobic coatings, cleaning nozzles, and induced vibration. For the fluid flowing in the plates/tubing 250, cleaning strategies may be employed to address fouling, such as regular reversed flow, using hydrochloric acid (HCL) to remove scales, etc.

Cooling fluid, lubrication fluid, etc., may be pumped through the heat exchanger 112 (i.e., through the plates or tubing 250) for cooling, as indicated in FIG. 2. In other embodiments, the system 100 of either FIG. 1 or 2 may include one or more intermediate liquid-liquid (or any other type) heat exchangers to transfer heat from sub-circuits to a main cooling fluid circuit that includes the heat exchanger 112, so as to avoid transporting large volumes of lubrication, etc., from the gel mixing assembly 214.

Figure 4:
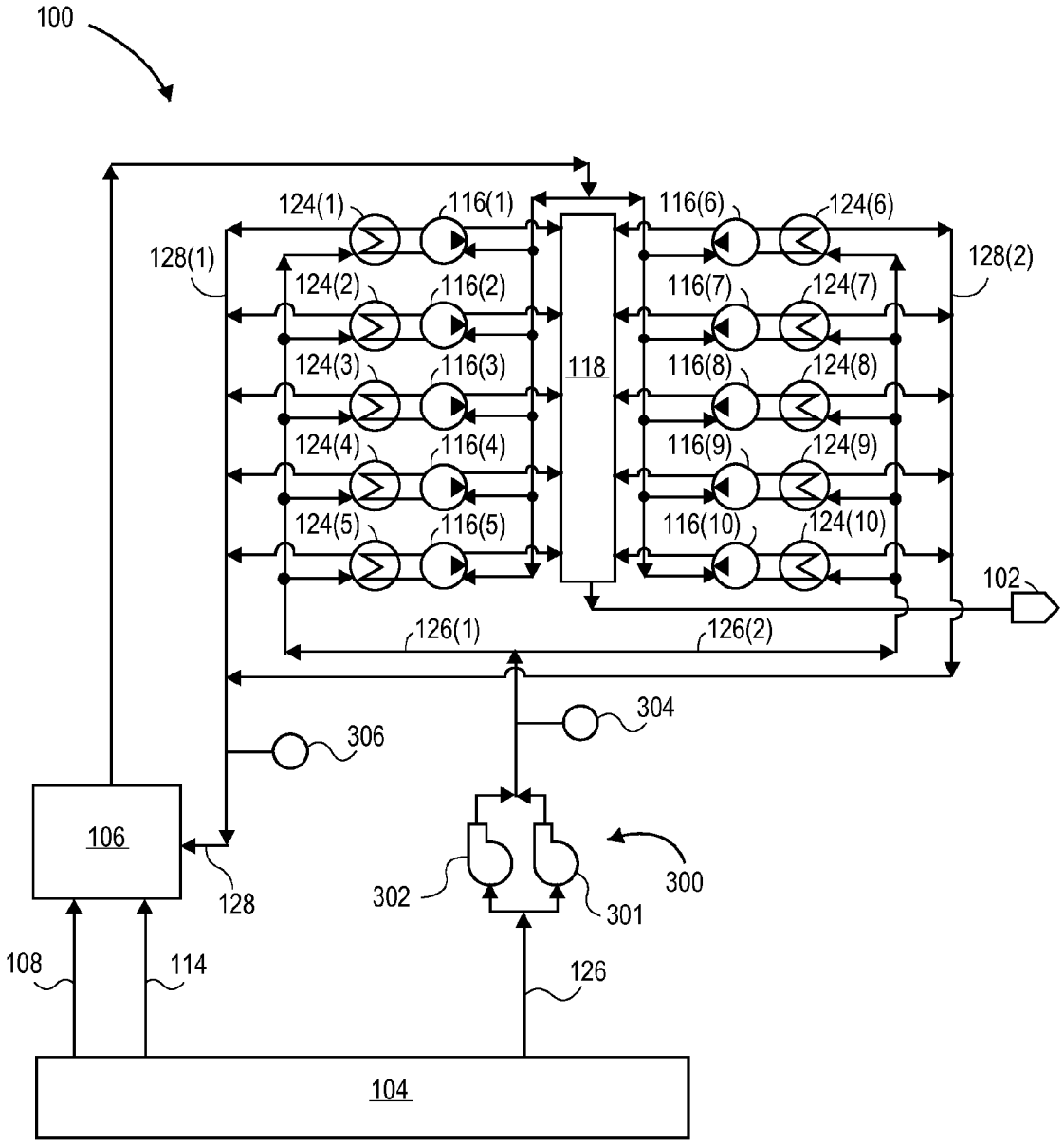
FIG. 4 illustrates a schematic view of the system, showing additional details of the cooling fluid being delivered to the heat exchangers, according to an embodiment.

FIG. 4 illustrates a schematic view of the system 100, showing additional details of the process fluid being delivered to the heat exchangers 124(1)-(10), according to an embodiment. As shown, the system 100 may include a utility pump module 300, which may be disposed in the inlet line 126 extending from the process fluid source 104 to the heat exchangers 124(1)-(10). In an embodiment, the utility pump module 300 may include one or more pumps, for example, two pumps 301, 302 configured to pump in parallel. In some cases, the pumps 301, 302 may be redundant, such that one can be removed for maintenance from the utility pump module 300, while the other performs the pumping function of the utility pump module 300. Further, the utility pump module 300 (e.g., the pumps 301, 302) may be operable at a plurality of setpoints across a range of speeds, such that an amount of process fluid pumped from the fluid source 104 may be controlled. Further, the utility pump module 300 may contain fluid processing capabilities, such as filtering of suspended particles to reduce the possibility of fouling in heat exchangers 124(1)-(10).

The utility pump module 300 may supply process fluid through the inlet line 126, which may be split into the inlet lines 126(1) and 126(2), and into the heat exchangers 124(1)-(10) in parallel, for example. The process fluid, after transferring heat from the heat exchangers 124(1)-(10), may then exit the heat exchangers 124(1)-(10) and proceed through the return lines 128(1) and 128(2), and to the assembly 106 (described in greater detail above). In lieu of or in addition to the centralized pumping module 300, one, some, or each of the heat exchangers 124(1)-(10) may be coupled with or include a separate pump, which may be located onboard the high-pressure pumps 116(1)-(10) and configured to cycle fluid through the heat exchanger 124 (1)-(10) with which it is connected.

It will be appreciated that the inlet line 126 being split into lines 126(1) and 126(2) and the return line 128 being split into lines 128(1) and 128(2) is merely one example among many possible. For instance, the lines 126, 128 may not be split, but may extend between the rows of pumps 116(1)-(10), for example, physically parallel to one another, with the hotter return line 128 being disposed vertically above the cooler inlet line 126. In other embodiments, the inlet line 126 and return lines 128 may be split into three or more lines each.

The system 100 may also include inlet and return sensors 304, 306 disposed in the inlet line 126 and the return line 128, respectively, and configured to measure a temperature of the process fluid therein. In some cases, the return sensor 306 may be provided by the sensor 221 that is shown in and described above with reference to FIG. 2, but in others may be separate therefrom. The inlet and return sensors 304, 306 may provide operating information, which may be employed to control the utility pump module 300, for example, to increase or decrease flowrate.

In an example, a difference between the temperatures read by the sensors 306 and 304 may indicate a temperature rise across the heat exchangers 124(1)-(10). This temperature rise may be controlled by modulating the setpoint, and thus throughput, of the utility pump module 300, within temperature and flow design limits as explained above with reference to FIG. 2. Further, the inlet sensor 304 may provide data related to ambient conditions, which may inform the system 100 controller as to the effect that increased or decreased flowrate will have on the return temperature.

Figure 5:
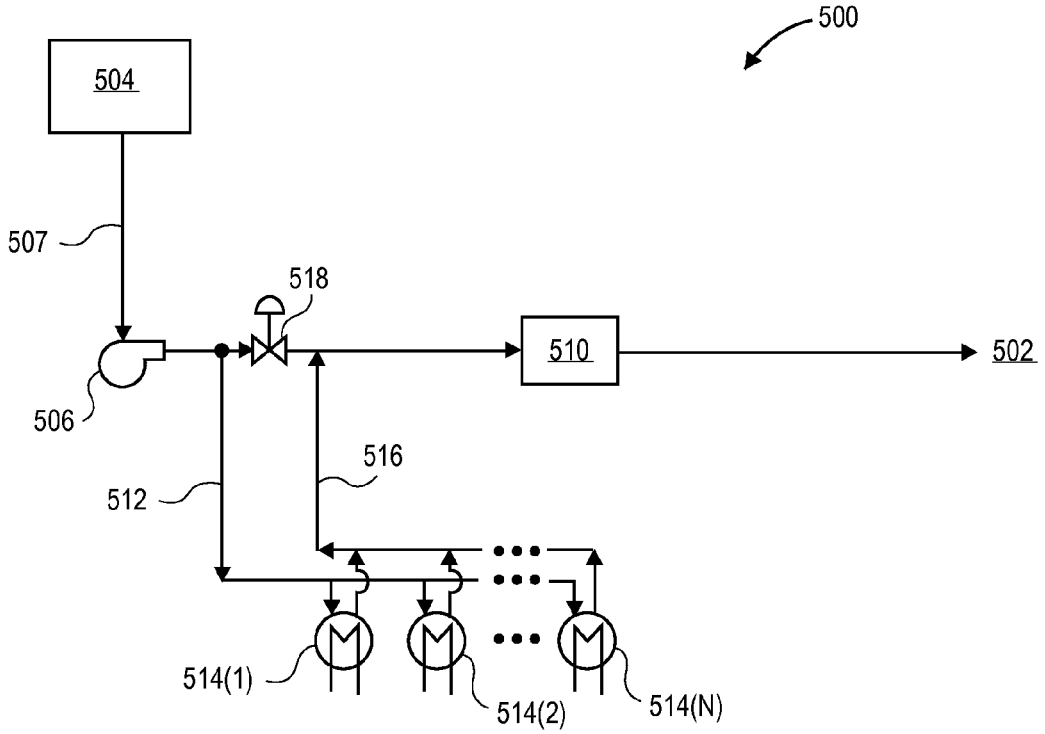
FIG. 5 illustrates a schematic view of another system, according to an embodiment.

FIG. 5 illustrates a schematic view of another system 500, according to an embodiment. The system 500 may be, for example, a general fluid delivery system, which may deliver any type of process fluid into a wellbore 502. The system 500 may include a source 504 of process fluid, for example, brine, mud, water, etc., and may include other liquids, solutes, suspended material, etc.

The process fluid may be received from the source 504 into a pump 506, which may be representative of two or more pumps, operating in series or in parallel. The process fluid may be pumped by the pump 506 to one or more high-pressure pumps 510, where the process fluid may be pumped at high pressure into the wellbore 502. The process fluid may also be employed to cool heat-generating components of the system 500. For example, a portion of the process fluid may be diverted from the main line 507 and into line 512.

The diverted process fluid may be provided to one or more heat exchangers (e.g., heat exchangers 514(1), 514(2), . . . 514(N)), as shown. The heat exchangers 514(1)-(N) may be liquid-liquid and/or gas-liquid heat exchangers and may be fluidly coupled with heat-generating components of the pump 506, high-pressure pumps 510, and/or any other components of the system 500. Accordingly, the heat exchangers 514(1)-(N) may receive hot fluid (e.g., lubrication oil, cooling fluid, etc.) from the heat-generating components, and transfer heat therefrom into the process fluid received via line 512. The process fluid, having coursed through one or more of the heat exchangers 514(1)-(N) may then be returned via return line 516 to main line 507 and pumped into the high pressure pumps 510 or any other point of the main line 507. A control valve 518 may be provided to regulate the flowrate through the heat exchangers 514(1)-(N).

Diverting the process fluid into line 512 may be controlled by a temperature control system configured to maintain the temperature in the process fluid within a range of acceptable temperatures. For example, the temperature control system may include the control valve 518. The temperature control system may also be electrically coupled with the pump 506, so as to control a speed thereof, and thus a flowrate therethrough, in any suitable manner. The range of temperatures may include temperatures of the process fluid that increase mixing efficiency. Further, the low side of the range may be above the freezing point of the process fluid, while the high side is below the boiling point of the process fluid and may be, for example, below temperatures that may negatively affect mixing efficiency, system 500 performance, etc.

Figure 6:
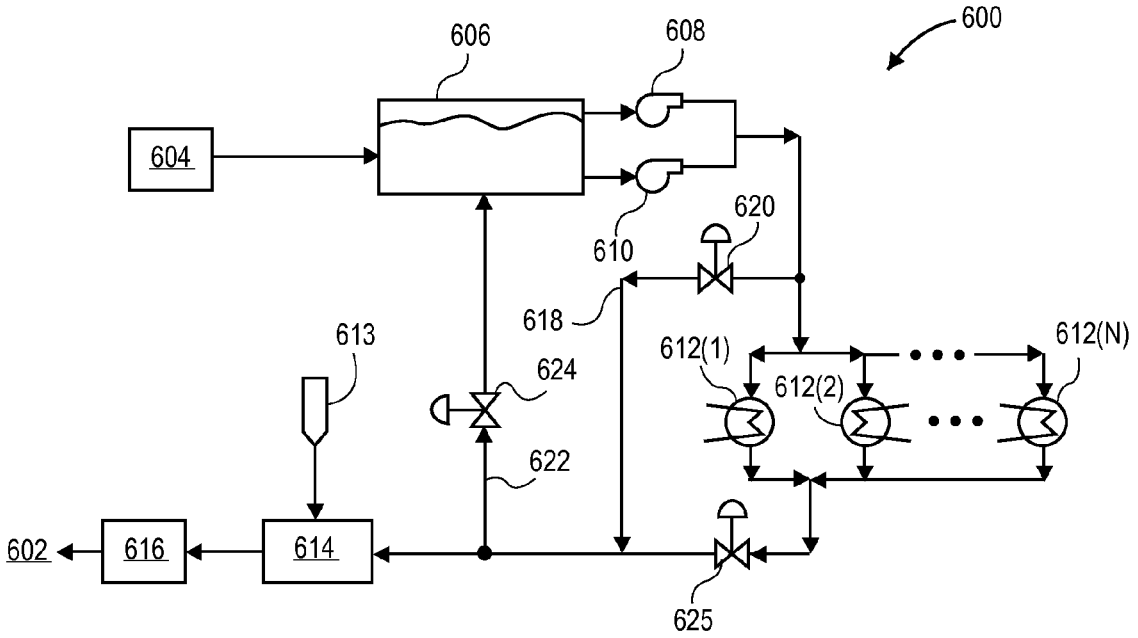
FIG. 6 illustrates a schematic view of another system, according to an embodiment.

FIG. 6 illustrates a schematic view of another system 600, according to an embodiment. The system 600 may also be configured to provide cement into a wellbore 602. The system 600 may include a source 604 of process fluid, which may be or include one or more tanks containing a fluid such as water. The system 600 may also generally include a displacement tank 606, one or more pumps (two shown: 608, 610), one or more heat exchangers (e.g., 612(1), 614(2), . . . (N)), a cement mixer 614, and one or more high-pressure pumps 616.

The process fluid may be provided to the displacement tank 606 from the process fluid source 604. From the displacement tank 606, the process fluid may be received by the pumps 608, 610, which may be configured in parallel, as shown, or in series, or may each be representative of two or more pumps arranged in any configuration. From the pumps 608, 610, the fluid may be delivered to the heat exchangers 612(1)-(N).

From the heat exchangers 612(1)-(N) the process fluid may be delivered to the cement mixer 614. The cement mixer 614 may include one or more pumps, ejectors, mixers, etc., and may be driven by one or more electric motors, diesel engines, turbines, or other drivers, any of which may generate heat. In the cement mixer 614, the process fluid may be combined with dry and/or liquid additives, such as cement, hardening agents, foam-reducers, etc., e.g., from a supply such as a hopper 613, such that the process fluid becomes a cement slurry. The process fluid may then be provided to one or more high-pressure pumps 616 and delivered into the wellbore 602. The high-pressure pumps 616 may also include drivers and/or other components that generate heat.

The heat-generating components of the high-pressure pumps 616, the cement mixer 614, and/or the pumps 608, 610 may be fluidly coupled with a hot side of one or more of the heat exchangers 612(1)-(N). Accordingly, the process fluid passing through the heat exchangers 612(1)-(N) may form the cold side thereof, so as to transfer heat from the hot side and away from the system 600 as the process fluid is delivered into the wellbore 602.

The recovery of heat from the heat-generating components may be beneficial to assist in mixing in the cement mixer 614 and/or to avoid freezing of the process fluid in the system 600. This may be taken into account in determining a range of flowrates for heat exchangers 612(1)-(N). The flowrate into the cement mixer 614 may be controlled using control valves 620 and 625 that regulate the proportion of flow through a line 618 and through heat exchangers 612 (1)-(N). The valves 620, 625 may be positioned so to result in the appropriate flow is being received by heat exchangers 612(1)-(N) to result in sufficient heat transfer, and if the total flowrate through the exchangers is below requirements, the fluids may be topped up via line 618.

The valves 620, 625 may form part of a temperature control system, configured to maintain the temperature in the process fluid within a range of acceptable temperatures. The temperature control system may also be coupled with the pumps 608, 610, so as to control a speed thereof, and thus a flowrate therethrough, in any suitable manner The range of temperatures may include temperatures of the process fluid that increase mixing efficiency. Further, the low side of the range may be above the freezing point of the process fluid, while the high side is below the boiling point of the process fluid and may be, for example, below temperatures that may negatively affect mixing efficiency, system 600 performance, etc.

Further, in some cases, the high-pressure pumps 616 may idle, i.e., not be actively pumping cement into the wellbore 602. Accordingly, heat transfer in the heat exchangers 612 (1)-(N) may be minimal, as the hot fluid may be delivered at low temperatures compared to when the high-pressure pumps 616 are operating at higher rates under load, and, further, process fluid demands by the cement mixer 614 may also be minimal. Thus, at least some of the process fluid may be recirculated from downstream of the heat exchangers 612(1)-(N) back to the displacement tanks 606, e.g., via a recirculation line 622, which may be controlled by a control valve 624.

Figure 7:
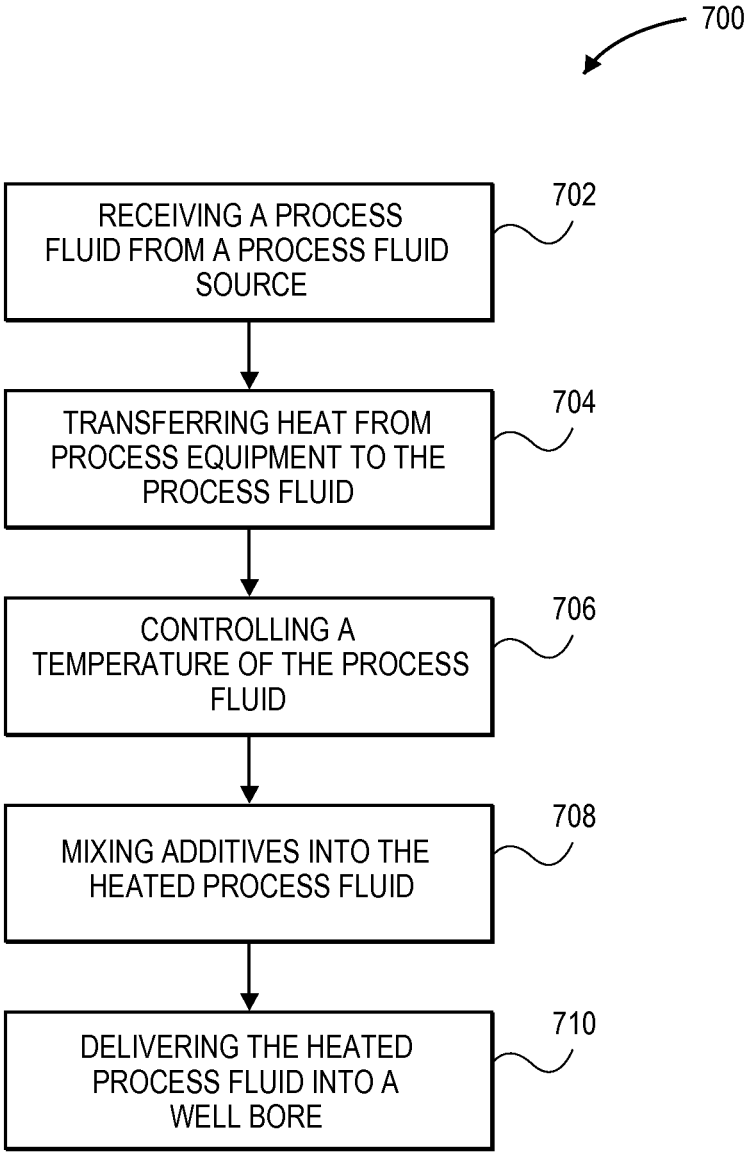
FIG. 7 illustrates a flowchart of a method for cooling process equipment, according to an embodiment.

FIG. 7 illustrates a flowchart of a method 700 for cooling process equipment, according to an embodiment. The method 700 may proceed by operation of one or more of the systems 100, 500, 600, and/or one or more embodiments thereof, described above with reference to any of FIGS. 1-6. Accordingly, the method 700 is described herein with reference; however, it will be appreciated that this is merely for purposes of illustration. The method 700 is not limited to any particular structure, unless otherwise expressly provided herein.

The method 700 may include receiving process fluid from a process fluid source 104, as at 702. The method 700 may also include transferring heat from process equipment to the process fluid, such that a heated process fluid is generated, as at 704. For example, heat exchangers 112, 124 may be fluidly coupled with the process fluid source 104, so as to receive the process fluid therefrom. The heat exchangers 112, 124 may also be fluidly coupled with process equipment, e.g., the mixing assembly 214 and high-pressure pumps 116, respectively. The heat exchangers 112, 124 may receive a hot fluid from the process equipment, transfer heat therefrom to the process fluid, and return a cooled fluid to the process equipment, thereby cooling the process equipment.

Further, the method 700 may include controlling a temperature of the process fluid, as at 706. For example, the method 700 may include one or more control valves, e.g., 208 and/or 218, that may control a flowrate between the heat exchangers 112 and/or 124 and any other components of the systems 100, 500, 600, including the process fluid source 104.

In one specific example, controlling the temperature in the process fluid at 704 may include mixing the heated process fluid (i.e., downstream from one or both heat exchangers 112, 124) with a cooler process fluid, e.g., straight from the fluid source 104. For example, controlling the temperature may include determining that a temperature of the heated process fluid upstream from the mixing assembly 214 and downstream from the heat exchanger 124 is above temperature threshold. In response, the method 700 may include combining the heated process fluid with process fluid having a lower temperature, e.g., directly from the fluid source 104, such that a combined process fluid is produced having a temperature that is less than the temperature of the heated process fluid prior to combination. Further, the temperature of the combined process fluid may be monitored (e.g., using the sensor 220 in FIG. 2), and modulated by controlling the flowrates of the heated process fluid and the process fluid at the lower temperature, e.g., by proportional control using the control valve 218 (FIG. 2).

Further, controlling the temperature at 706 may also include flowing back at least some of the process fluid to the process fluid source 104. For example, controlling the temperature at 706 may include flowing back to the process fluid source 104 at least some of the process fluid that flows through the heat exchanger 124, or flowing back process fluid that flows through the heat exchanger 112, or both (e.g., via the flowback valve 208 of FIG. 2).

The method 700 may also include mixing additives into the heated process fluid, as at 708. Such additives may include gelling agents, proppant, etc. For example, the additives may be mixed into the process fluid using one of the mixing assemblies 214, 216. In an embodiment, the process fluid may be heated in one or both of the heat exchangers 112, 124 prior to being received into the mixing assembly, e.g., the gel mixing assembly 214.

In an embodiment, for example, the embodiment of the system 600 illustrated in FIG. 6, the method 700 may also include receiving the process fluid in the displacement tank 606 from the process fluid source 604. The process fluid may also be recirculated back to the displacement tank 606 after circulation through the heat exchangers 612(1)-(N), e.g., when the high-pressure pumps 616 are idle. Further, the method 700 may include mixing at least a portion of the process fluid with cement and performing a cementing operation using the at least a portion of the heated process fluid.

The method 700 may also include delivering the process fluid into the wellbore 102, as at 710. For example, delivering the process fluid may include performing a hydraulic fracturing operation, a cementing operation, or any other operation in the wellbore 102, using the process fluid.

While the present teachings have been illustrated with respect to one or more embodiments, alterations and/or modifications may be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment Finally, "exemplary" indicates the description is used as an example, rather than implying that it is an ideal.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. A system for cooling a process equipment, comprising:

a process fluid source;

a heat exchanger fluidly coupled with the process equipment and the process fluid source, wherein the heat exchanger is configured to receive a process fluid from the process fluid source and transfer heat from the process equipment to the process fluid, wherein the process equipment comprises a mixing assembly, the mixing assembly being configured to receive process fluid from the heat exchanger and mix the process fluid received from the heat exchanger with a gelling agent, a proppant, or both, wherein the process equipment comprises a pump coupled with the mixing assembly, the pump being configured to receive process fluid from the mixing assembly and pump the process fluid into the wellbore, wherein the heat exchanger comprises a first heat exchanger fluidly coupled with the mixing assembly so as to transfer heat from the mixing assembly, and a second heat exchanger fluidly coupled with the pump so as to transfer heat from the pump, wherein the mixing assembly is fluidly coupled with the second heat exchanger, so as to receive process fluid from the second heat exchanger; and a control system fluidly coupled with the heat exchanger, wherein the control system is configured to adjust a temperature of the process fluid heated in the heat exchanger, wherein at least a portion of the process fluid heated in the heat exchanger is delivered into a wellbore at a temperature below a boiling point of the process fluid.

2. The system of claim 1, wherein the control system comprises a control valve fluidly coupled with the second heat exchanger, the process fluid source, and the mixing assembly, wherein the control valve controls a flowrate of process fluid from the second heat exchanger to the mixing assembly, or from the process fluid source to the mixing assembly, or both, based at least partially on a temperature of process fluid downstream from the second heat exchanger and upstream from the mixing assembly.

3. The system of claim 1, wherein the control system comprises a flowback control valve fluidly coupled with a point downstream from the first heat exchanger, and with the second heat exchanger and the fluid source, wherein the flowback control valve is configured to control a flowrate of process fluid from the second heat exchanger back to the process fluid source, a flowrate of process fluid from the second heat exchanger to the point downstream from the first heat exchanger, or both.

4. The system of claim 1, further comprising a tank configured to receive process fluid from the first heat exchanger, the second heat exchanger, and from the mixing assembly, wherein the second heat exchanger is disposed at least partially in the tank.

5. The system of claim 1, wherein the process equipment comprises a cement mixer.

6. A method for cooling process equipment, comprising:

receiving a process fluid from a process fluid source;

receiving a first portion of the process fluid in a first heat exchanger that is fluidly coupled with a mixing assembly thereby transferring heat from a process equipment to the first portion of the process fluid, such that a first heated process fluid is generated;

receiving at least a portion of the first heated process fluid in a mixing assembly;

mixing one or more additives with the first heated process fluid using the mixing assembly;

receiving a second portion of the process fluid in a second heat exchanger that is fluidly coupled with a pump, so as to transfer heat from the pump to the second portion of the process fluid, such that a second heated process fluid is generated;

controlling a temperature of the heated process fluid such that the heated process fluid is maintained in a range of temperatures, wherein a maximum of the range is below a boiling point of the process fluid;

joining the first and second portions of the heated process fluid; and delivering at least a portion of the heated process fluid into a wellbore.

7. The method of claim 6, wherein controlling the temperature of the heated process fluid comprises:

combining, upstream from the mixing assembly, the first portion of the heated process fluid with additional process fluid from the process fluid source, such that a combined process fluid is produced having a temperature that is lower than a temperature of the at least a portion of the heated process fluid prior to the combining.

8. The method of claim 6, wherein controlling the temperature of the heated process fluid comprises:

determining that a temperature of the first portion of the heated process fluid upstream from the mixing assembly is above temperature threshold; and in response, combining the first portion of the heated process fluid with process fluid having a lower temperature, such that a combined process fluid is produced having a temperature that is less than the temperature of the heated process fluid.

9. The method of claim 8, wherein controlling the temperature of the heated process fluid further comprises:

determining that the temperature of the combined process fluid is higher than the temperature threshold; and increasing a flowrate of the process fluid having the lower temperature, or reducing a flowrate of the at least a portion of the heated process fluid, or both, so as to reduce the temperature of the combined process fluid upstream of the mixing device.

10. The method of claim 6, wherein mixing comprises:

mixing at least some of the second portion of the process fluid with a gelling agent, using a mixing assembly positioned downstream from the second heat exchanger, such that a gelled process fluid is produced and wherein joining comprises:

combining the gelled process fluid with at least some of the first portion of the process fluid, such that a diluted, gelled process fluid is produced; and receiving the diluted, gelled process fluid into a tank.

11. The method of claim 10, wherein controlling the temperature of the heated process fluid further comprises:

flowing back to the process fluid source at least some of the second portion of the process fluid downstream from the second heat exchanger and upstream of the mixing assembly; and flowing back to the process fluid source some of the first portion of the process fluid downstream from the first heat exchanger and upstream of a point where the at least some of the first portion of the process fluid is combined with the gelled process fluid.

12. The method of claim 10, further comprising transferring heat from the mixing assembly to the diluted, gelled process fluid in the tank.

13. The method of claim 6, further comprising:

receiving the process fluid in a displacement tank; and recirculating at least a portion of the heated process fluid to the displacement; and mixing at least a portion of the heated process fluid with a cement, wherein delivering at least a portion of the heated process fluid into the wellbore comprises performing a cementing operation using the at least a portion of the heated process fluid.

14. The method of claim 6, wherein delivering at least a portion of the heated process fluid into the wellbore comprises:

combining the heated process fluid with a gelling agent, a proppant, or both; and performing a hydraulic fracturing operation using the heated process fluid.

15. A system for hydraulic fracturing, comprising:

a process fluid source comprising a process fluid;

a fluid preparation assembly comprising at least one mixing assembly and a first heat exchanger, wherein the at least one mixing assembly and the first heat exchanger are fluidly coupled with the process fluid source so as to receive process fluid therefrom;

a plurality of pumps fluidly coupled with the fluid preparation assembly so as to receive the process fluid therefrom and pump the process fluid into a wellbore, so as to perform a hydraulic fracturing operation in the wellbore; and a plurality of second heat exchangers fluidly coupled with the plurality of pumps, wherein the plurality of second heat exchangers receive a hot fluid from the plurality of pumps and return a cooled fluid thereto, the plurality of second heat exchangers being fluidly coupled with the process fluid source and the at least one mixing assembly, wherein the plurality of second heat exchangers receive the process fluid from the process fluid source and wherein the at least one mixing assembly receives the process fluid from the plurality of second heat exchangers, wherein the process fluid received from the plurality of second heat exchangers has a temperature that is higher than the process fluid in the process fluid source; and one or more control valves fluidly coupled with the first heat exchanger, the plurality of second heat exchangers, and with the process fluid source, wherein the one or more control valves are configured to combine heated process fluid received from the first heat exchanger and the plurality of second heat exchangers with a cooler process fluid, to control a temperature of the process fluid delivered to the wellbore, wherein the temperature is maintained below a boiling point of the process fluid.

* * * * *